United States Patent [19]

Heredy

[11] 4,092,236

[45] May 30, 1978

[54] MOLTEN SALT HYDROCONVERSION PROCESS

[75] Inventor: Laszlo A. Heredy, Canoga Park, Calif.

[73] Assignee: Rockwell International Corporation, El Segundo, Calif.

[21] Appl. No.: 718,731

[22] Filed: Aug. 30, 1976

[51] Int. Cl.[2] ..... C10G 1/08

[52] U.S. Cl. ..... 208/10; 208/8; 208/108

[58] Field of Search ..... 208/8, 10, 108

[56] References Cited

U.S. PATENT DOCUMENTS

| | | | |
|---|---|---|---|
| 2,768,935 | 10/1956 | Watkins | 208/8 |
| 3,677,932 | 7/1972 | Hardesty et al. | 208/10 |
| 3,679,577 | 7/1972 | Wantland et al. | 208/10 |
| 3,708,270 | 1/1973 | Birk et al. | 208/8 |
| 3,745,109 | 7/1973 | Heredy et al. | 208/108 |
| 3,779,722 | 12/1973 | Tatum | 208/8 |
| 3,966,582 | 6/1976 | Cramer | 208/8 |
| 4,003,823 | 1/1977 | Baird et al. | 208/108 |

*Primary Examiner*—Delbert E. Gantz

*Assistant Examiner*—James W. Hellwege

*Attorney, Agent, or Firm*—L. L. Humphries; Henry Kolin; Clark E. DeLarvin

[57] ABSTRACT

Hydrocarbonaceous materials such as petroleum residuums, coal, lignite or the like are introduced into a molten salt bath maintained in a reaction zone at elevated temperature and pressure. Hydrogen also is introduced into the reaction zone in an amount sufficient to provide a pressure in the reaction zone within the range of from about 30 to 400 atmospheres. The hydrocarbonaceous material is reacted for a time sufficient to produce cracked products including a major amount of liquid and a minor amount of gaseous and solid products of enriched hydrogen content. The molten salt bath comprises at least one alkali metal hydroxide which preferably is sodium hydroxide. Substantially all of the sulfur and ash constituents of the hydrocarbonaceous material are retained in the molten salt. When the hydrocarbonaceous material is a normally solid material such as coal, it advantageously is crushed and slurried in an organic hydrogen donor solvent prior to its introduction into the molten salt bath.

8 Claims, 1 Drawing Figure

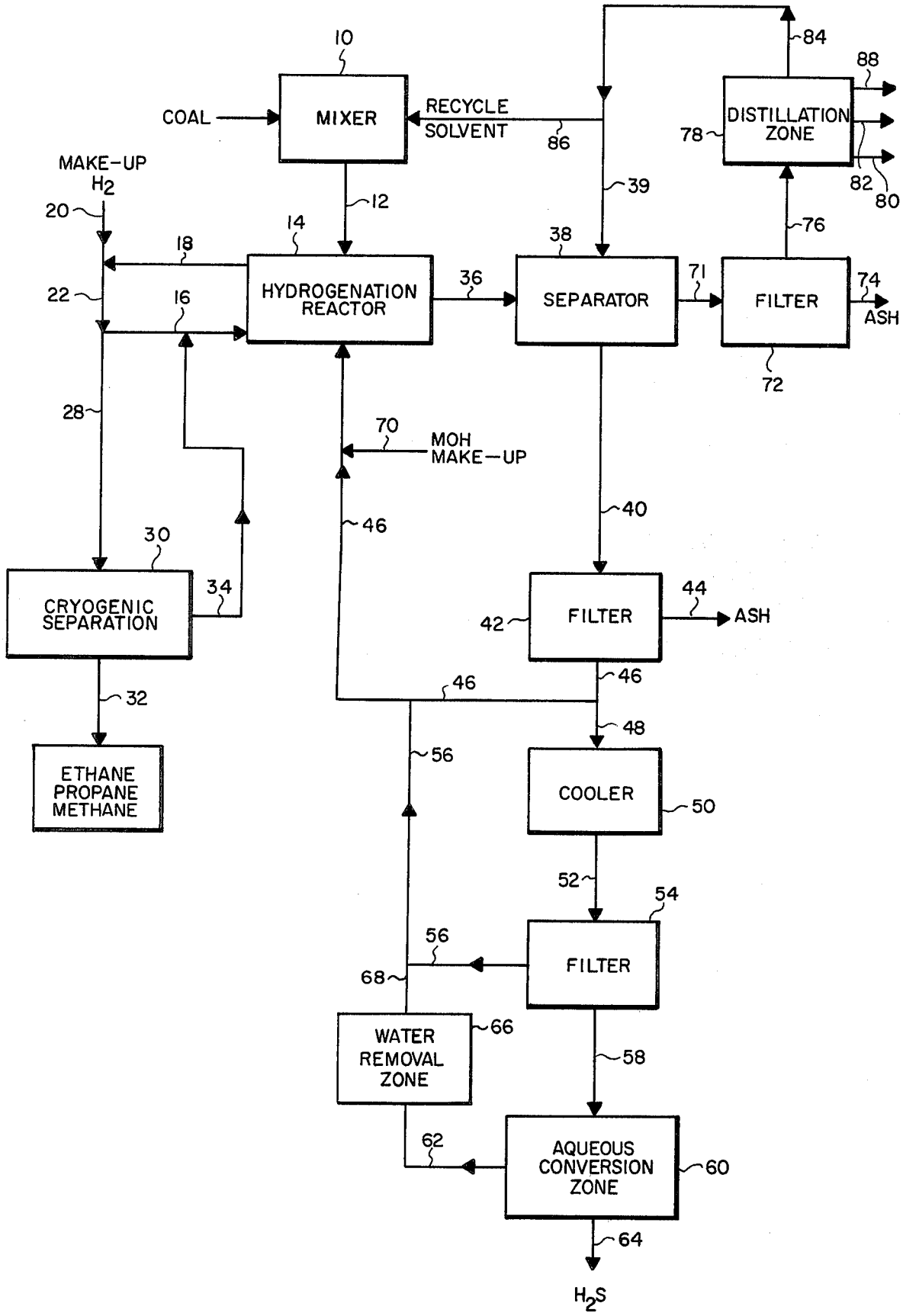
10
MIXER
COAL
RECYCLE SOLVENT
86
84
88
DISTILLATION ZONE
78
82
80
MAKE-UP $H_2$
20
12
39
14
18
38
76
HYDROGENATION REACTOR
36
SEPARATOR
71
FILTER
74
ASH
22
16
72
28
70
MOH MAKE-UP
40
46
30
CRYOGENIC SEPARATION
34
FILTER
44
ASH
42
46
46
32
48
56
ETHANE PROPANE METHANE
COOLER
50
52
54
56
FILTER
68
WATER REMOVAL ZONE
66
58
62
AQUEOUS CONVERSION ZONE
60
64
$H_2S$

MOLTEN SALT HYDROCONVERSION PROCESS

BACKGROUND OF THE INVENTION

1. Field of the Invention

This invention relates to the field of hydrocarbon conversion processes. More particularly, this invention relates to hydrocracking partially refined petroleum products such as distillation residuals of coal, coal extracts and the like, to form more valuable products. Still further, this invention relates to a method for hydrocracking a hydrocarbonaceous material in an alkali metal hydroxide melt.

2. Description of the Prior Art

The steadily increasing demand for distillate petroleum products and a decreasing supply of crude oils provides incentive for processes which upgrade high boiling petroleum residuals, coal, coal extracts, and other such polynuclear hydrocarbonaceous stocks. Such hydrocarbonaceous stocks usually contain sulfur, oxygen and nitrogen as well as various organometallic compounds. A suggested conversion process for upgrading such hydrocarbonaceous stocks is hydrocracking.

Hydrocracking is a decomposition of hydrocarbons at high pressures and elevated temperatures, with the addition of hydrogen and usually in the presence of a catalyst such as zeolite with a platinum, tungsten oxide, cobalt-molybdenum oxide or a nickel component. These catalysts may be altered by promotion with another metal or by some pretreatment such as sulfiding. Under these conditions hydrogenation occurs simultaneously with cracking. Thus, the buildup of tar or coke on the catalyst surface is substantially minimized. A number of problems are involved in these processes, however, including catalyst deterioriation caused by the sulfur, ammonia or ash in the feedstock, presence of hydrogen sulfide in the products, and catalyst deactivation resulting from coke deposition on the catalyst surfaces.

It has been proposed that many of these disadvantages can be overcome by a hydrocracking process employing a molten salt as a catalyst. It has been suggested, for example, to use zinc chloride or a zinc chloride mixed with a zinc oxide acceptor. The use of such molten salt catalyst does obviate many problems of the prior art. The catalyst in the form of a liquid offers a number of advantages, including excellent heat transfer characteristics and continual renewal of fresh catalyst surfaces. In addition, contaminants such as catalyst poisons can be withdrawn with a bleed stream of the molten salt to allow uninterrupted operation. The use of zinc chloride is not without problems, however, since zinc chloride is highly corrosive at elevated temperatures. Further, the solubility of the heavy hydrocarbons in molten zinc chloride is high and makes separation of the organic and salt phases difficult. In U.S. Pat. Nos. 3,677,932 and 3,736,250 it is suggested that the solubility of the zinc halide for hydrocarbon may be substantially reduced by the addition thereto of certain alkali metal halides. These processes still are not altogether satisfactory in that separation of the hydrocarbon products from the salt is still difficult. Further, the regeneration of such mixed salts is a complex procedure requiring high-temperature treatment in a corrosive atmosphere.

In U.S. Pat. No. 3,745,109 there is disclosed a hydrocarbon conversion process. Hydrocarbons such as partially refined petroleum are contacted with a sulfide-containing alkali metal carbonate melt. In the presence of hydrogen and at the appropriate temperature and pressure conditions the partially refined petroleum is hydrocracked. This process, although obviating many of the problems of the prior art zinc chloride processes, still is not altogether satisfactory. More particularly, the yields obtainable are lower than is desirable. A commercially viable hydrocracking process should provide a conversion of at least of 75 to 80% of the feedstock. Further, at least about 60 wt.% of the product should be obtained as a normally liquid product substantially free of sulfur and metallic ash constituents such that it is suitable for use as a feed material to a conventional petroleum refinery.

U.S. Pat. No. 3,846,275 suggests a coal liquefaction process, which comprises contacting a solid carbonaceous material with a reducing gas, water, and a catalytic compound containing a sulfur component and an alkaline metal ion, or ammonia ion at liquefaction conditions to produce a mixture comprising an aqueous phase and a hydrocarbonaceous phase which are separated. The hydrocarbonaceous phase then is extracted with a hydrocarbonaceous solvent to provide an extract fraction and a solid residual fraction. The liquefaction product is recovered from the extract fraction.

A similar process is disclosed in U.S. Pat. No. 3,796,650. The suggested process comprises contacting coal with water, at least a portion of which is in a liquid phase, a reducing gas, and a compound selected from ammonia and carbonates and hydroxide of alkali metals, at liquefaction conditions including a temperature of 200° to 370° C to provide a hydrocarbonaceous product. It is a disadvantage of both the foregoing processes that the yield of liquid product and amount of feed material converted is less than desirable. In addition, such processes require an aqueous phase reaction. The high temperatures necessarily result in a requirement for excessively high pressures to maintain the aqueous phase.

Another such aqueous process is disclosed in U.S. Pat. No. 3,642,607, wherein a mixture of coal, a hydrogen donor oil, carbon monoxide, water, and an alkali metal hydroxide are heated to a temperature of about 400° to 450° C, and under a total pressure of at least about 4000 psig to obtain dissolution of the coal. However, this process suffers from the same disadvantages as the other aforementioned aqueous processes.

Thus, it is seen that each of the above noted conversion processes is in need of improvement.

SUMMARY OF THE INVENTION

Broadly, the present invention provides a process for hydrocracking a hydrocarbonaceous material. The process comprises introducing a hydrocarbonaceous material into a molten salt bath maintained in a reaction zone at an elevated temperature and pressure, and in the presence of hydrogen for a time sufficient to produce cracked products including a major amount of liquid and a minor amount of gaseous and solid products having an enriched hydrogen content. The molten salt bath comprises at least one alkali metal hydroxide, the preferred alkali metal being sodium. Generally, it is preferred that the reaction zone be maintained at a temperature from about 250° to 500° C, and that the hydrogen be introduced into the reaction zone in an amount sufficient to provide a pressure in the reaction zone within the range from about 30 to 400 atmospheres.

BRIEF DESCRIPTION OF THE DRAWING

The sole FIGURE shows a schematic flow diagram of a hydrocarbon conversion process for cracking hydrocarbonaceous feedstocks to form predominantly liquid products.

DETAILED DESCRIPTION OF THE PREFERRED EMBODIMENTS

The present invention is broadly directed to the hydrocracking of hydrocarbonaceous materials to produce valuable gaseous, liquid and solid products of enriched hydrogen content.

In accordance with the process of this invention, a variety of feedstocks may be converted to produce gaseous, solid and predominantly liquid hydrocarbon products enriched in hydrogen content. It is an advantage of the present invention that there is no limitation on the amount of sulfur and/or metals that may be present in the feedstock. Suitable hydrocarbonaceous materials for use as feedstock in the present invention are heavy hydrocarbon feedstocks such as crude oils, heavy residuum such as atmospheric and vacuum residua, crude bottoms, pitch, asphalt, and other heavy hydrocarbon pitch-forming residua. In addition, the process of the present invention is applicable to the conversion of coal, coal tar distillates, coal extracts, natural tars, and the like, which contain from as low as 2 up to about 6 wt.% sulfur or more in addition to various ash constituents.

The process of the present invention is particularly applicable to crude oils, aromatic tars, atmospheric and vacuum residua, which contain materials boiling above about 650° F at atmospheric pressure, and to the treatment of a coal extract or a mixture of coal and a solvent. When the process herein disclosed is utilized to treat a particularly preferred hydrocarbonaceous material, for example, coal, the coal advantageously is ground or pulverized to provide particles sufficiently small to pass through a 100 mesh Tyler sieve or smaller. Coal ground sufficiently to pass through a 200 mesh sieve is particularly preferred. Thus, while it is not essential to the process, it is preferred when a carbonaceous solid such as coal is to be employed in the process that it first be reduced to a particulate comminuted form to reduce the time required for the carbonaceous solid to react with the hydrogen.

When the hydrocarbonaceous feed material is solid such as ground or pulverized coal, it is admixed or slurried with a solvent, preferably an organic hydrogen donor solvent. Such hydrogen donor solvents are well known to those versed in the art, and comprise aromatic hydrocarbons which are partially hydrogenated, generally having one or more of the nuclei at least partially saturated. Typical examples of such solvents are tetralin, dihydrophenanthrene, dihydroanthracene, dihydrochrysenes, tetrahydrochrysenes, tetrahydropyrenes, tetrahydrofluoranthenes, and the like. Of particular value in the process of this invention as hydrogen donor solvents are the hydrophenanthrenes and hydroanthracenes such as dihydroanthracene. Alternatively, a condensed aromatic hydrocarbon, such as phenanthrene, can be used for the hydrogen donor solvent. In such instance the aromatic hydrocarbon will be converted to a partially hydrogenated hydrogen donor solvent during the hydrocracking process. It will be understood that these materials may be obtained from any source, but are readily available from coal processing systems as anthracene oil and the like. Of particular value are recycle oils obtained from the hydroconversion process of the present invention. Advantageously, the hydrogen donor solvent will be supplied in an amount sufficient to provide a solvent to coal ratio of from about 1:3 to 5:1. The higher ratios provide the best hydrocracking results, however, a ratio in excess of about 5:1 generally is uneconomical. Very poor results are obtained with solvent-to-coal ratios of less than about 1:3. A solvent-to-coal ratio of from about 1:1 to 3:1 provides a satisfactory product yield along with economic solvent utilization and is therefore particularly preferred.

The hydrocarbonaceous material is introduced into a molten salt bath contained in a reaction zone. The molten salt bath comprises at least one alkali metal hydroxide and may comprise a mixture of such hydroxides. The particularly preferred alkali metal hydroxide is sodium hydroxide because of its lower cost and availability. In addition to the alkali metal hydroxide, the molten salt also may include a minor amount of an alkali metal carbonate. Indeed, in the present process, when the hydrocarbonaceous feed material contains oxygen, some of the hydroxide will be converted to a carbonate. The alkali metal carbonate constituent acts primarily as a diluent, and provides no significant benefits to the process of the present invention. However, no significant detrimental effects have been observed with alkali metal carbonate concentrations of up to about 40 wt.%. Thus, the molten salt bath of the present invention may contain up to about 40 wt.% of alkali metal carbonate based on the total weight of the salt bath.

When the hydrocarbonaceous feed material contains sulfur constituents, the sulfur will react with and be retained in the molten salt bath as an alkali metal sulfide. An alkali metal sulfide concentration of from about 2 to 15 wt.% has actually been found to provide beneficial effects, namely, the presence of the alkali metal sulfide appears to enhance the conversion rate of the hydrocarbonaceous material. Thus, a particularly preferred molten salt comprises a major amount (65 to 98 wt.%) of an alkali metal hydroxide, a minor amount (0 to 20 wt.%) of an alkali metal carbonate, and from 2 wt.% up to about 15 wt.% of an alkali metal sulfide.

If desired, a conventional liquefaction catalyst also may be added to the molten salt bath of the present process. Suitable catalyst includes metals from Group 8 of the Periodic Table of the Elements, and particularly the sulfides of these metals and especially iron sulfide, molybdenum sulfide, nickel sulfide and cobalt sulfide. The above noted catalyst may be utilized at a concentration of from about 0.1 wt.% to about 10 wt.% of the molten salt bath. The preferred concentration for such catalyst is from about 0.5 wt.% to about 5 wt.% of the molten salt bath.

The quantity of molten salt utilized is not critical, however, it generally is preferred to provide an amount of salt sufficient to provide a weight ratio of hydrocarbonaceous feed material to molten salt of from about 10:1 to 1:10, with a weight ratio of about 3:1 to 1:3 being particularly preferred.

In accordance with the present process, hydrogen is also introduced into the reaction zone. The hydrogen should be introduced in an amount to provide a hydrogen partial pressure in the reaction zone within the range of from about 30 to 500 atmospheres, and preferably between about 50 to 300 atmospheres. The hydrogen partial pressure is the principal gas constituent. Therefore, it is customary to simply monitor the total pressure in the reaction zone rather than determine the actual hydrogen partial pressure. In accordance with the present process, at least 0.5 wt.% (based on the weight of feed material) and generally from about 1 to 3 wt.% of the hydrogen will be taken up by the hydrocarbonaceous feed material. The hydrogen may be present in the form of a hydrogen-containing gas which may be obtained from any number of sources including commercially available pure hydrogen, naphtha reformers, hydrogen plants, as well as the offgas from any hydrotreating process. The hydrogen-containing gas may be pure or contain other gaseous materials such as light hydrocarbons ($C_1$ to $C_3$). The hydrogen-containing gas may be introduced into the reaction zone alone or be mixed with the hydrocarbon feed prior to being introduced into the reaction zone.

The hydrogenation zone or reactor utilized in the present process may be any suitable vessel or reactor which can maintain the reactants at the required temperatures and pressures to provide conversion conditions. For example, a conventional rocking autoclave is a suitable reactor for use in a batch-type operation. A variety of suitable vessels (which are customarily nickel lined) for use as a reactor are known in the art of coal liquefaction. Preferably, the hydrogenation zone includes a means for admixing the reactants by stirring or other agitation. For example, the desired agitation may be obtained by sparging the molten salt bath with the gaseous hydrogen or by providing a mechanical stirer.

The hydrocracking process of the present invention is favored by high temperatures and pressures. More particularly, the higher temperatures and pressures increase the reaction rate of the hydrocarbonaceous material and hydrogen, and also the higher temperatures promote the cracking of the hydrocarbonaceous material. Thus, a temperature of from about 350° to 550° C is suitable, and a temperature of from about 400° to 500° C is particularly preferred. The pressure within the reaction zone may range from as low as about 30 to as high as about 500 atmospheres. Generally, however, pressures of from about 50 to 300 atmospheres are preferred. When the reaction conditions are maintained within the foregoing temperature and pressure ranges, an average residence time for the feed material in the reactor of from about 10 to 100 minutes generally is sufficient to obtain the desired results. Longer or shorter residence times may, of course, be used, depending upon the specific nature of the feed, the degree of conversion desired, and the contact efficiency of the specific reactor system employed.

The conversion products produced in the reaction zone comprise a major amount (at least 50 wt.%) of liquid products. The term "liquid products" as used herein refers to products which are fluid or flowable at 50° C. Generally, at least 80 wt.% of the feed material will be converted to such a liquid product of enriched hydrogen content. There also will be produced a minor amount (2 to 10 wt.%) of a normally gaseous hydrocarbon (at atmospheric temperature and pressure) and a solid hydrocarbonaceous product (about 5 to 30 wt.% of one having an end melting point in excess of about 50° C). The normally gaseous hydrocarbonaceous products may be withdrawn and subjected to a conventional separation technique, such as cryogenic separation, to recover an ethane-propane fraction, a synthetic natural gas (methane) fraction and substantially pure hydrogen for recycling to the hydrogenation zone. The liquid products are suitable for use as a feed material to a conventional petroleum refinery process to produce gasoline, kerosene, and other valuable liquid products. Alternatively, the liquid products are utilizable as a substantially ash and sulfur-free (less than 0.5 wt.% S) fuel. The solid products are similar in property to the asphalts and asphaltenes produced as a by-product from the conventional processing of crude oils and may be used in a similar manner. Alternatively, the solid products may be subjected to further hydrogenation in the same manner as the original feed material.

It is an advantage of the present invention that in addition to promoting the conversion rate of the hydrocarbonaceous materials, the molten medium of the instant invention offers the additional advantage of significantly lowering the emission of pollutants into the atmosphere by absorbing or reacting at least a portion, and generally a major portion of the sulfur and/or sulfur compounds produced during the actual cracking or conversion operation, the impurities being retained by the molten medium. The liquid hydrocarbon products formed with the conversion process of the instant invention contain a significantly reduced amount of heavy metal, nitrogen and sulfur compounds compared to that originally contained in the hydrocarbonaceous feed material. Still further, the molten medium of the instant invention possesses good thermal conductivity to allow efficient heat transfer.

The invention will be further understood by reference to the accompanying drawing, which is a schematic flow diagram of a process for hydrocracking a hydrocarbonaceous feedstock in the molten salt bath of the instant invention.

Pulverized coal from a source not shown and an organic hydrogen donor solvent from a source to be described are introduced into a mixer 10, where they are intimately admixed to form a slurry of coal in the solvent. The coal-solvent slurry is withdrawn via conduit 12 for introduction into a reaction zone defined by a hydrogenation reactor 14. Contained within hydrogenation reactor 14 is a molten salt bath, which consists essentially of molten sodium hydroxide and containing lesser amounts of sodium carbonate (from about 0 to 20 wt.%) and sodium sulfide (from about 2 to 15 wt.%). High pressure hydrogen gas also is introduced into the hydrogenation reactor 14 via a conduit 16. The reaction conditions in hydrogenation reactor 14 are maintained within a temperature range of from about 400° to 500° C and a pressure range of from about 50 to 300 atmospheres.

A stream of gaseous reaction products, including the excess hydrogen, is withdrawn from hydrogenation reactor 14 via a conduit 18 and combined with makeup hydrogen introduced via a conduit 20. The combined streams are recycled to hydrogenation reactor 14 via conduits 22 and 16. Advantageously, a side stream of a mixture of the excess hydrogen and gaseous hydrocarbon reaction product is withdrawn from conduit 22 via a conduit 28 and introduced into a cryogenic separation zone 30. Gaseous hydrocarbon products comprising, for example, ethane, propane, and synthetic natural gas are withdrawn from cryogenic separation zone 30 via a conduit 32 for recovery as a salable product. Substantially pure gaseous hydrogen is withdrawn from cryogenic separation zone 30 via a conduit 34 for return to the hydrogenation reactor via conduit 16.

A mixture of hydrocracked products and molten salt is withdrawn from hydrogenation reactor 14 via a conduit 36 and introduced into a separation zone defined by a separator 38. Separator 38 is sufficiently large to provide for gravity separation of the hydrocracked products (organic phase) from the molten salt phase by virtue of their different densities. In addition, to further facilitate the phase separation, an organic solvent is introduced into separator 38 via a conduit 39, said solvent being obtained from a source to be described. A stream of molten salt is withdrawn from separator 38 via a conduit 40 and passed through a filter 42 for removal of suspended solids such as coal ash and insoluble entrained organic matter such as unreacted coal. The insolubles are removed from filter 42 via a conduit 44 for disposal. Advantageously, the insolubles are washed with water to solubilize and recover any alkali metal hydroxide for return to the hydrogenation reactor. The molten salt is withdrawn from filter 42 via conduit 46 for return to the hydrogenation reactor 14. A side stream of the molten salt is introduced via a conduit 48 into a cooler 50, wherein the molten salt is cooled to precipitate metal sulfides and carbonates which have accumulated in the salt. The cooled (but still molten) salt is withdrawn from cooler 50 via a conduit 52 and introduced into a filter 54. The filtrate from filter 54 is withdrawn via a conduit 56 for return to hydrogenation reactor 14 via conduit 46. The precipitated sulfide and carbonate solids are recovered from filter 54 via a conduit 58 for introduction into an aqueous conversion zone 60, wherein the metal sulfide and carbonate are converted to the corresponding metal hydroxide, for example, by treatment first with $CO_2$ and then with lime. An aqueous stream of metal hydroxide formed in aqueous conversion zone 60 is withdrawn via a conduit 62 and passed through a water removal zone 66 for removal of any water vapors contained therein. Water removal zone 66 may be any of the conventional water removal apparatus known to those versed in the art such as a vacuum evaporator, kiln or the like. The substantially moisture-free salt is removed from water removal zone 66 via a conduit 68 and returned to hydrogenation reactor 14. Makeup salt is added via a conduit 70 as required. Also produced in aqueous conversion zone 60 is a stream of hydrogen sulfide gas, which is withdrawn via a conduit 64 and may be passed to a conventional Claus plant for recovery of the sulfur values therefrom.

The organic phase is withdrawn from separator 38 via a conduit 71 for introduction into a filter 72. The suspended solids in the organic phase such as ash and unconverted organic residue are removed via a conduit 74 for disposal. The filtrate (solids-free organic phase) is withdrawn from filter 72 via a conduit 76 and introduced into a distillation zone 78. In distillation zone 78 the organic phase is separated into various fractions, for example, by thermal distillation to provide a high boiling or residual fraction (boiling point in excess of about 360° C) which is removed via a conduit 80. The residual fraction can be recycled for additional hydrocracking or used as a low sulfur fuel. There also is produced in distillation zone 78 an intermediate distillate fraction having a boiling point of from about 240° to 360° C, which is removed via conduit 82. The intermediate distillate is suitable for use a low sulfur fuel oil or for further treatment to produce a diesel fuel. A lighter solvent fraction having a boiling point within the range of from about 200° to 240° C is withdrawn via a conduit 84 for recycle to separator 38 via conduit 39. A portion of the lighter solvent is recycled to mixer 10 for use with additional coal via a conduit 86. A light oil fraction having a boiling point in the range of from about 60° to 200° C is withdrawn via a conduit 88. The light oil fraction is suitable as a feed to a conventional refining process to produce a gasoline or aromatic chemicals.

The invention will be further understood by reference to the following example which is set forth for the sole purpose of further illustrating the invention and should not be construed as limiting its scope.

EXAMPLE 1

Four hydrocracking tests were carried out in a mechanically agitated autoclave, which was maintained at a temperature of 425° C for a time of 60 minutes. In each test a sufficient amount of hydrogen was introduced into the autoclave to provide a substantial excess over that required for hydrogenation of the carbonaceous material and in an amount sufficient to maintain a pressure in the autoclave of about 200 atmospheres. In the first three tests 200 gm of a molten salt bath comprising 90 wt.% NaOH, 7 wt.% of $Na_2CO_3$, and 3 wt.% of $Na_2S$ was used. In the fourth test the molten salt bath comprised 90 wt.% $Na_2CO_3$ and 10 wt.% $Na_2S$ for purposes of comparison. When the reaction products from each test (excluding gaseous products) are collected and heated, they are found to have a melting point substantially below 100° C. The following tables present the results of these experiments.

In Table 1 the reactants and products for each experiment, their weights and descriptions are given. The weight of each product is given as the weight of the fraction as it was obtained from the autoclave and may therefore have included some weight due to ash or salt content. The gaseous products were analyzed using a gas chromatograph.

Table 1

| Sample | Weight (g) | Description |
|---|---|---|
| 1. phenanthrene* | 100.00 | White solid |
| 1-1 | 49.80 | Black & white solid |
| 1-2 | 57.18 | Brown solid from melt |
| product gas | 0.18 | $CH_4$ (0.18g) |
| 2. coal extract* | 50.00 | Black solid |
| 1-3 | 16.57 | Brown liquid** |
| 1-4 | 6.46 | Black solid |
| 1-5 | 28.51 | Black solid from melt |
| product gas | 2.69 | $CH_4$(1.91g)$C_2H_6$(.43g) $C_3H_8$(.35g) |
| 3. coal + phenanthrene* (25.00 gm of each) | 50.00 | Black solid (50-100 mesh) + white solid |
| 1-6 | 1.80 | Orangish-brown liquid** |
| 1-7 | 4.58 | Tan solid |
| 1-8 | 23.83 | Black solid |
| 1-9 | 16.70 | Black solid from melt |
| product gas | 1.32 | $CH_4$(.86g)$C_2H_6$(.24g) $C_3H_8$(.22g) |
| 4. coal + phenanthrene* (50.00 gm of each) | 100.00 | Black solid (50-100 mesh) + white solid |
| 1-11 | 2.35 | Tan solid |
| 1-12 | 147.95 | Black solid |
| 1-13 | 7.55 | Black solid from melt |
| product gas | 1.73 | $CH_4$(1.07g)$C_2H_6$(0.42g) $C_3H_8$(0.24g) |

*designates reactant feed material
**at room temperature

Table 2 presents the analytical data from an elemental analysis of the reactants and products. It will be noted that all products displayed evidence of hydrogenation. The product liquids from the coal extract and coal-phenanthrene hydrogenations in accordance with the present invention (Tests 2 and 3) show a significant increase in the hydrogen-to-carbon ratio, viz. 47% to 49%, respectively. In addition, it will be noted that in Test No. 3 all of the first 3 fractions had a sulfur content of less than 0.5%, thus making them suitable for use as non-polluting fuels without further treatment.

Table 3 shows the solubility data on the individual product fractions. The solubility data for the experiments are summarized in Table 4. The solubility of the products for each of the three experiments displays evidence of conversion to asphaltenes (increased benzene solubility) and substantial overall conversion (increased benzene-methanol solubility).

Table 5 shows some typical distillation data for the liquid fraction obtained from the experiment performed in accordance with the present invention (Test No. 2 liquid sample 1-3).

Table 2

ELEMENTAL ANALYSES OF COAL, COAL EXTRACT AND THEIR HYDROGENATION PRODUCTS

| Expt. | Sample | % H | % C | % S | % Ash | Total % | H/C | Total S (g) |
|---|---|---|---|---|---|---|---|---|
| 1 | Phenanthrene[1] | 5.66 | 94.34 | — | — | 100.00 | 0.72 | — |
| | 1-1/1-2 Com.[3] | 6.05 | 93.95 | — | — | 100.00 | 0.77 | — |
| 2 | Coal Extract[1] | 6.65 | 86.15 | 1.76 | 8 | 94.56 | 0.93 | 0.88 |
| | 1-3 | 10.22 | 89.50 | 0.06 | 0 | 99.78 | 1.37 | 0.01 |
| | 1-4 | 7.17 | 65.68 | 0.17 | 8.75 | 81.77 | 1.01* | 0.01 |
| | 1-5 | 7.44 | 58.55 | 2.67 | 2.58 | 71.19 | 1.02* | 0.75 |
| 3 | Coal + Phen[1] | 5.67 | 86.02 | 3.34[5] | 3.86[5] | 96.82 | 0.79 | .84 |
| | 1-6 | 9.13 | 92.20 | 0.03 | 0 | 101.36 | 1.18 | <0.01 |
| | 1-7 | 7.18 | 92.69 | 0.10 | 0.42 | 100.39 | 0.93 | <0.01 |
| | 1-8 | 7.68 | 88.65 | 0.24 | 0.68 | 97.43 | 1.04 | .04[4] |
| | 1-9 | 6.71 | 64.79 | 2.32 | 8.65 | 82.47 | 1.00* | .56[4] |
| 4 | Coal + Phen[2] | 5.67 | 86.02 | 3.34[5] | 3.86[5] | 96.82 | 0.79 | 1.67 |
| | 1-11 | 7.26 | 90.93 | # | 0.31 | 98.50 | 0.96 | # |
| | 1-12 | 6.25 | 88.31 | 0.91 | 2.64 | 98.11 | 0.85 | .83 |
| | 1-13 | 5.47 | 76.43 | 8.47 | 3.11 | 93.48 | 0.86 | .50 |

[1]Catalyst = 90 wt.% NaOH-7 wt.% $Na_2CO_3$-3% $Na_2S$
[2]Catalyst = 90 wt.% $M_2CO_3$-10 wt.% $Na_2S$
[3]Calculated from GLC data
[4]Data corrected to account for 25% loss in material balance
[5]Sulfur and ash data for coal only
Insufficient sample for analysis (assumed to be <0.01g as in 1-7)
*Ratio is calculated assuming difference from 100% total is due to loss of carbon during analysis.

Table 3

SOLUBILITY DATA

| Sample | Benzene Soluble (%) | Benzene-Methanol Soluble (%) |
|---|---|---|
| Coal extract[1] | 57 | 74 |
| 1-3 | 100 | 100 |
| 1-4 | 60* | 82* |
| 1-5 | 81* | 85* |
| Coal-phenanthrene[1] | 50 | 51 |
| 1-6 # | 100 | 100 |
| 1-7 | 100 | 100 |
| 1-8 | 93 | 96 |
| 1-9 | 53* | 89* |
| Coal-phenanthrene[2] | 50 | 51 |
| 1-11 | 99* | 99* |
| 1-12 | 82* | 95* |
| 1-13 | 50* | 59* |

Liquid product assumed to be 100% Benzene soluble
*Corrected for ash
[1]Catalyst = 90 wt.% NaOH-7% $Na_2OC_3$-3% $Na_2S$
[2]Catalyst = 90 wt.% $M_2CO_3$ - 10 wt.% $Na_2S$ Table 4

SUMMARY OF SOLUBILITY DATA

| Sample | Benzene Solubility (%) | Benzene-Methanol Solubility (%) |
|---|---|---|
| Coal extract (Test #2) | 57 - 85 | 75 - 90 |
| Coal-phenanthrene (Test #3) | 50 - 75 | 51 - 94 |
| Coal only (Test #3) | 0 - 51 | <1 - 87 |
| Coal-phenanthrene | 50 - 81 | 51 - 93 |

Table 4-continued

SUMMARY OF SOLUBILITY DATA

| Sample | Benzene Solubility (%) | Benzene-Methanol Solubility (%) |
|---|---|---|
| (Test #4) Coal only | 0 - 61 | <1 - 85 |

Table 5

LIQUID SAMPLE 1-3

| Fraction | Boiling Range | % by Weight |
|---|---|---|
| Light Oil | 20 - 160° C | 2 |
| Middle Oil | 160 - 230° C | 3 |
| Heavy Oil | 230 - 270° C | 9 |
| Anthracene Oil | 270 - 340° C | 27 |
| Pitch (residue) | above 340° C | 59 |

EXAMPLE 2

The following example is set forth to demonstrate a particularly preferred embodiment of the present invention, wherein it is possible to obtain greater than 60% conversion of the coal to a product which is liquid at room temperature. Fifty grams of ground coal was mixed with 50 gm of phenanthrene and placed in an autoclave containing 200 gm of pure sodium hydroxide. The autoclave was heated to a temperature of 475° C and a sufficient amount of hydrogen introduced to provide a pressure in the autoclave of about 200 atmospheres. The autoclave was maintained at that pressure and temperature for about 2 hours. After cooling to room temperature, the autoclave was opened and 58 gm of a flowable liquid (at room temperature) was recovered from the autoclave.

From other work, the maximum amount of liquid obtainable from the phenanthrene under these same conditions would be about 20 gm. Therefore, the balance of the liquid recovered, or 38 gm, represents liquefied coal. Thus, it is seen that 76% of the initial coal feed was converted to a product which was liquid at room temperature. The recovered liquid is suitable as a feed material for a conventional petroleum refining process for the production of distillate products such as kerosene, gasoline, and the like.

When this product was analyzed, it was found to contain less than about 0.09% sulfur and to be substantially free of other ash constituents. This example demonstrates the advantages of operating at the higher temperature when it is desired to obtain a product which is predominantly a liquid at room temperature and substantially sulfur free. In addition, a substantial amount of the organically bound nitrogen content of the coal was reacted to form a valuable ammonia product in accordance with this higher temperature mode of operation.

EXAMPLE 3

This example demonstrates the applicability of the present invention to a petroleum residual. One hundred grams of a petroleum vacuum residual, having a softening point of about 100° C and containing about 1.7 wt.% sulfur, was placed in an autoclave containing 200 gm of sodium hydroxide. The temperature in the autoclave was raised 475° C, and a sufficient amount of hydrogen introduced to provide a pressure in the autoclave of about 200 atmospheres. The autoclave was maintained at that temperature and pressure for about 2 hours. Thereafter, the autoclave was cooled to room temperature and the contents removed.

Approximately 53.5 gm of a light oil, which was liquid at room temperature, was obtained. The oil had a sulfur content of less than about 0.1%. An additional 15.5 gm of a pitch, which was soft at room temperature, was obtained. This pitch product is a liquid at 50° C. The pitch contained about 0.5% sulfur. About 12.8 gm of a hard pitch containing 1.1% sulfur also was recovered. Approximately 10 gm of gaseous products, principally methane, ethane and propane, also were produced in the reaction. These gaseous products had less than 5 ppm sulfur. The 8.2 gm of feed material unaccounted for are presumed to be on the walls of the autoclave or retained in the salt.

The results of this experiment clearly demonstrate the applicability of the present invention, to treat a petroleum residual and obtain a high yield of a product which is liquid at room temperature, substantially sulfur-free and suitable as a feed material to a conventional petroleum refining process for the production of valuable petroleum distillates. In addition, a significant amount of the petroleum residual (about 16%) was obtained as a soft pitch having a sufficiently reduced sulfur value, such that the pitch could be used as an inexpensive source of a low sulfur fuel. Further, this example also demonstrates the advantage of operating at higher temperatures to obtain greater yields of products which are liquid at room temperature.

The invention has been described herein with reference to preferred embodiments and certain specific examples. However, it will be apparent to those skilled in the art that many other modifications, adaptations and uses for this hydrocarbon conversion process are possible without departure from the spirit and scope of the invention as defined by the following claims.

What is claimed is:

1. A process for hydrocracking coal comprising:

introducing coal into a molten sale bath maintained in a reaction zone at a temperature of from about 350° to about 550° C;

introducing hydrogen into the reaction zone an amount sufficient to provide a pressure in the reaction zone within the range of from about 30 to 500 atmospheres; and reacting said coal for a time sufficient to produce cracked products including liquid, gaseous and solid products of enriched hydrogen content, said molten salt bath comprising a major amount of at least one alkali metal hydroxide.

2. The process of claim 1 wherein said coal is ground and slurried in an organic hydrogen donor solvent prior to being introduced into said molten salt bath.

3. The process of claim 1 wherein said coal contains ash and sulfur constituents and said cracked gaseous and liquid products are substantially free of ash and sulfur.

4. The process of claim 3 wherein said molten salt bath includes a minor amount of an alkali metal carbonate and up to about 15 wt.% of an alkali metal sulfide.

5. The process of claim 1 wherein said molten salt bath is maintained in a reaction zone at a temperature of from about 400° to 500° C and said hydrogen is introduced in an amount sufficient to provide pressure in a reaction zone within the range of from about 50 to 300 atmospheres.

6. The process of claim 5 wherein said alkali metal is sodium.

7. A process for hydrocracking coal comprising introducing a mixture of an ash and sulfur-containing coal and an organic hydrogen donor solvent into a molten salt bath, maintained in a reaction zone at a temperature of from about 400° to 500° C;

introducing hydrogen into the reaction zone in an amount sufficient to provide a pressure in the reaction zone within the range of from about 50 to 300 atmospheres; and reacting the coal for a time sufficient to produce cracked products including liquid, gaseous and solid products of an enriched hydrogen content and substantially free of ash and sulfur, said molten salt bath comprising a major amount of an alkali metal hydroxide, a minor amount of an alkali metal carbonate, and up to about 15 wt.% of an alkali metal sulfide.

8. The process of claim 7 wherein said alkali metal is sodium.

* * * * *